US011844988B2

(12) United States Patent
Peyton

(10) Patent No.: US 11,844,988 B2
(45) Date of Patent: Dec. 19, 2023

(54) UNIVERSAL HEAVY BAG ATTACHMENT KIT

(71) Applicant: Peyton Ventures, LLC, Tigard, OR (US)

(72) Inventor: Cole Peyton, Tualatin, OR (US)

(73) Assignee: Peyton Ventures, LLC, Tigard, OR (US)

( * ) Notice: Subject to any disclaimer, the term of this patent is extended or adjusted under 35 U.S.C. 154(b) by 0 days.

(21) Appl. No.: 17/328,250

(22) Filed: May 24, 2021

(65) Prior Publication Data

US 2021/0402276 A1 Dec. 30, 2021

Related U.S. Application Data

(60) Provisional application No. 63/046,262, filed on Jun. 30, 2020.

(51) Int. Cl.

| | |
|---|---|
| ***A63B 69/20*** | (2006.01) |
| ***A63B 69/30*** | (2006.01) |
| *A63B 71/02* | (2006.01) |

(52) U.S. Cl.

CPC ..... *A63B 69/305* (2022.08); *A63B 69/30* (2022.08); *A63B 2071/026* (2013.01); *A63B 2209/10* (2013.01); *A63B 2244/102* (2013.01)

(58) Field of Classification Search

CPC ..... A63B 69/004; A63B 69/20; A63B 69/201; A63B 69/205; A63B 69/206; A63B 69/208; A63B 69/215; A63B 69/22; A63B 69/203; A63B 69/34; A63B 69/222; A63B 69/224; A63B 69/26; A63B 69/28; A63B 69/30; A63B 69/305; A63B 69/32; A63B 69/322; A63B 2244/10; A63B 2244/102; A63B 2244/104; A63B 2244/106; A63B 2244/108; A63B 2071/026; A63B 2209/10; F16M 13/027; F16L 3/137

See application file for complete search history.

(56) References Cited

U.S. PATENT DOCUMENTS 264,931 A * 9/1882 Cook ..... A63B 69/004 482/89
712,000 A * 10/1902 McFadden ..... A63B 69/004 482/89

(Continued)

FOREIGN PATENT DOCUMENTS

GB 2501730 A * 11/2013 ..... A63B 69/201

*Primary Examiner* — Joshua Lee

(74) *Attorney, Agent, or Firm* — Peter J. Ims; Westman, Champlin & Koehler, P.A.

(57) ABSTRACT

An attachment kit for a heavy bag includes a securing strap having a length between a first end and a second end and a securing mechanism that retains the securing strap about a perimeter of the heavy bag. The kit includes a plurality of connecting straps, each of the plurality of connecting straps having a length between a first connecting end and a second connecting end, wherein the first connecting end is positioned about the securing strap. The kit includes a tether having a top end and a bottom end, the top end couples to each of the second connecting ends of the plurality of connecting straps and a bottom end is couples to an anchor. When the securing strap is secured about a perimeter of the heavy bag and the tether is secured to the anchor, movement of a lower end of the heavy bag is limited.

18 Claims, 5 Drawing Sheets

(56) References Cited

U.S. PATENT DOCUMENTS

| | | | | | |
|---|---|---|---|---|---|
| 770,869 | A * | 9/1904 | Roe | A63B 69/004 | 59/95 |
| 4,103,889 | A * | 8/1978 | Lobur | A63B 69/305 | 273/DIG. 20 |
| 6,261,210 | B1 * | 7/2001 | Lishejkov | A63B 69/305 | 482/90 |
| 6,461,281 | B2 * | 10/2002 | Bouvier | A63B 69/305 | 482/86 |
| 8,721,505 | B2 * | 5/2014 | Conarty | A63B 69/206 | 482/89 |
| 8,973,875 | B2 * | 3/2015 | Cuadrado | A63B 69/305 | 248/689 |
| 9,211,465 | B1 * | 12/2015 | Lambrinos | A63B 69/305 | |
| 9,925,448 | B2 * | 3/2018 | Hockridge | A63B 71/023 | |
| 2016/0166909 | A1 * | 6/2016 | Heaney | A63B 69/004 | 482/83 |

* cited by examiner

UNIVERSAL HEAVY BAG ATTACHMENT KIT

CROSS REFERENCE TO RELATED APPLICATION(S)

The present application claims the benefit of U.S. Provisional Application Ser. No. 63/046,262 entitled UNIVERSAL HEAVY BAG ATTACHMENT KIT that was filed on Jun. 30, 2020, the contents of which are incorporated by reference in its entirety.

BACKGROUND

The present disclosure relates to a kit configured to attach to a heavy bag. More particularly, the present disclosure relates to an attachment kit that is securable to any typically constructed heavy bag where the attachment kit is configured to control the movement of the bottom end of the heavy bag.

Many people use heavy bags for training and exercise. Depending on the type of training, people strike the heavy bag with their fists, forearms, feet, shins and knees. For instance, a mixed martial arts athlete will strike the bag with all parts of his or her body that is a legal strike in a match, while people using the heavy bag for exercise typically strike the heavy bag with their fists, feet and shins.

A heavy bag is typically suspended above a floor level, where the bottom free end is allowed to move to dissipate the force of the strike. However, due to the weight of the heavy bag, typically between 60 pounds and 100 pounds, once the heavy bag starts to swing, the heavy bag has sufficient momentum to adversely affect a person's ability to train.

For instance, if a person is working out alone with the heavy bag and the heavy bag starts to excessively swing, the person can strike the heavy bag with enough force to stop and reverse the movement of the heavy bag, which at times has the potential to cause injury. Another alternative is to stop working out and to catch the heavy bag to still the movement, which can adversely affect the person's training.

It would be beneficial to be able to allow the bottom end of the heavy bag to swing in a controlled distance while not affecting the person's ability to strike the heavy bag during a workout. Controlling or limiting the movement of the bottom end of the heavy bag will allow a person to strike the heavy bag with as much force as desired, while limiting the momentum or movement of force of the heavy bag on the exerciser during a following strike and allowing the person to continue exercising without having to stop to control the movement of the heavy bag.

SUMMARY

An aspect of the present disclosure includes an attachment kit for a heavy bag. The attachment kit for a heavy bag includes a securing strap having a length between a first end and a second end and a securing mechanism configured to retain the securing strap about a perimeter of the heavy bag. The kit includes a plurality of connecting straps, each of the plurality of connecting straps comprising a length between a first connecting end and a second connecting end, wherein the first connecting end is configured to be positioned about the securing strap. The kit includes a tether having a top end and a bottom end, the top end configured to couple to each of the second connecting ends of the plurality of connecting straps and a bottom end is configured to couple to an anchor, wherein when the securing strap is secured about a perimeter of the heavy bag and the tether is secured to the anchor, movement of a lower end of the heavy bag is limited.

Another aspect of the present disclosure relates to a method of limiting movement of a bottom end of a heavy bag. The method includes providing a hanging heavy bag. The method further includes positioning a first end of each of a plurality of connecting straps, about a securing strap and arranging a securing strap around the perimeter of the heavy bag proximate a bottom end. The method further includes securing the securing strap about the perimeter of the heavy bag using a retaining mechanism and attaching a second end of each of the plurality of connecting straps to an anchor to limit movement of the bottom end of the heavy bag.

Another aspect of the present disclosure relates to an attachment kit for a heavy bag. The attachment kit includes a securing strap having a length between a first end and a second end and a securing mechanism configured to retain the securing strap about a perimeter of the heavy bag and a plurality of connecting straps. Each of the plurality of connecting straps has a length between a first connecting end and a second connecting end, a first loop proximate the first connecting end, the first loop configured to be positioned about the securing strap, a second loop proximate the second connecting end, and a ring retained by the second loop. The kit includes a tether having a top end and a bottom end, the top end configured to couple to each of the rings proximate the second connecting ends of the plurality of connecting straps and a bottom end is configured to couple to an anchor, wherein when the securing strap is secured about a perimeter of the heavy bag and the tether is secured to the anchor, movement of a lower end of the heavy bag is limited.

DETAILED DESCRIPTION

The present disclosure relates to a universal attachment kit for controlling a movement of a bottom end of a heavy bag. The universal attachment kit is configured to be secured about a circumference of the heavy bag proximate the bottom end where the kit is also configured to be secured to an anchor with a length of a tethering device, where the tethering device limits the movement of the lower end of the heavy bag.

Figure 1:
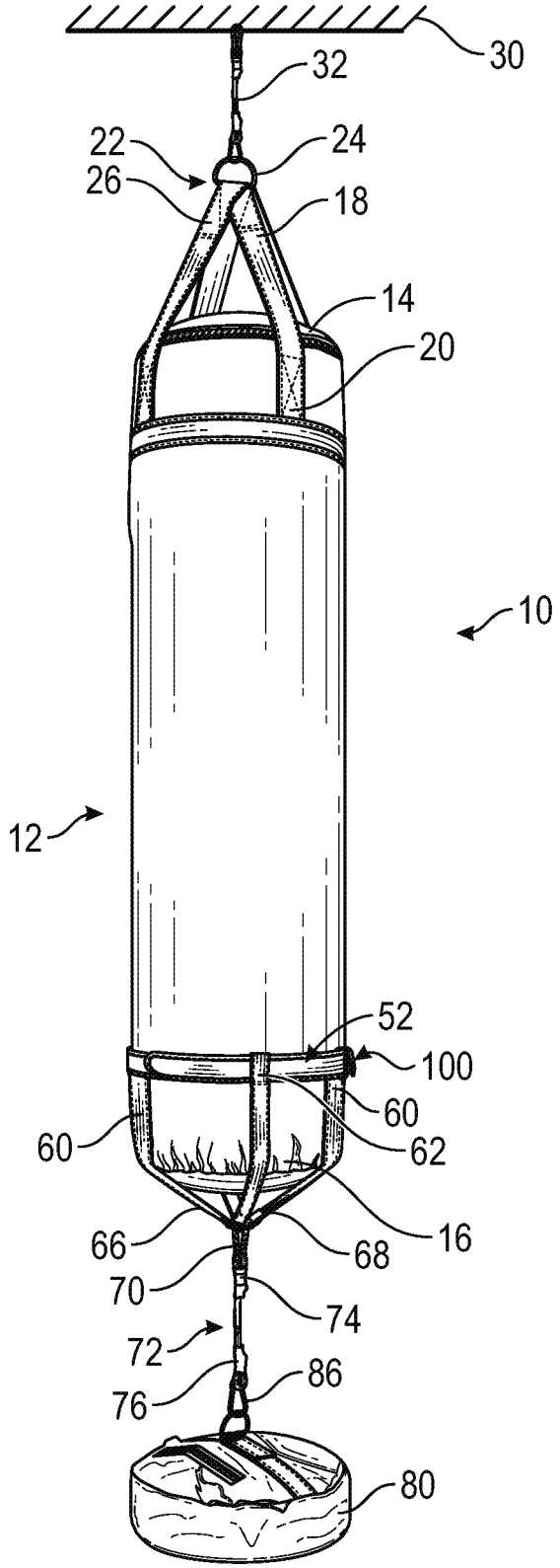
FIG. 1 is a schematic view of a suspended heavy bag secured with an attachment kit of the present disclosure.

A heavy bag is illustrated in FIG. 1 at 10. The heavy bag 10 is typically a cylindrical configuration which allows heavy bag 10 to be consistently struck from any angle. The heavy bag 10 includes a main body 12 between an upper end 14 and a lower end 16 where the main body 12, upper end 14 and lower end 16 define an interior cavity that is filled with any suitable ballast to a desired weight, typically between about 60 pounds and about 100 pounds. Exemplary, nonlimiting types of ballast include sand, scrap textiles, foam and water.

A bottom end 20 of a plurality of top straps 18 are secure to the main body 12 proximate the upper end 14, typically with stitching, where the plurality of top straps 18 are uniformly spaced about the perimeter of the main body 12. However, other securing members are within the scope of the present disclosure including, but not limited to, adhesives and rivets. A top end 22 of each of the plurality of top straps 18 include a D-ring 24, or some other form of ring, that is secured within a top end loop 26.

To hang heavy bag 10 from an elevated support 30, an attachment mechanism 32 is secured to the elevated support where the attachment mechanism 32, such as a spring-loaded clip or an S shaped attachment, is configured to accept the plurality of D-rings 24. With the plurality of D-rings 24 secured to the attachment mechanism 32, heavy bag 10 is hanging, where the lower end 16 is free to move. While a spring-loaded clip or S-shaped attachment is illustrated, the present disclosure is not limited to a particular attaching mechanism. For instance, the plurality of top straps 18 can be connected to the elevated support 30 with a chain or a rope.

The universal attachment kit 50 is illustrated being attached to the main body 12 of heavy bag 10 proximate the lower end 15 and attached to an anchor or weight 80 at ground level. The attachment kit 50 limits the movement of the lower end 16 as the main body 12 is struck from any angle.

Figure 2:
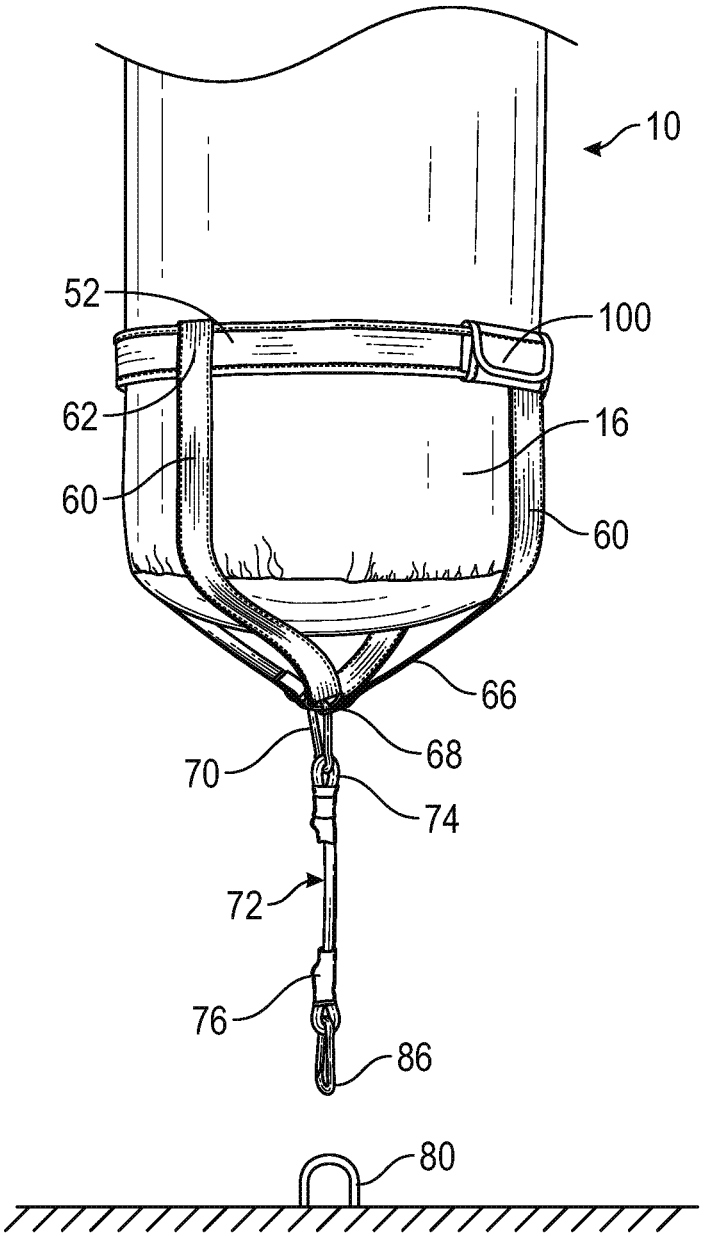
FIG. 2 is a close up view of the suspended heavy bag secured with the attachment kit of the present disclosure.
Figure 3:
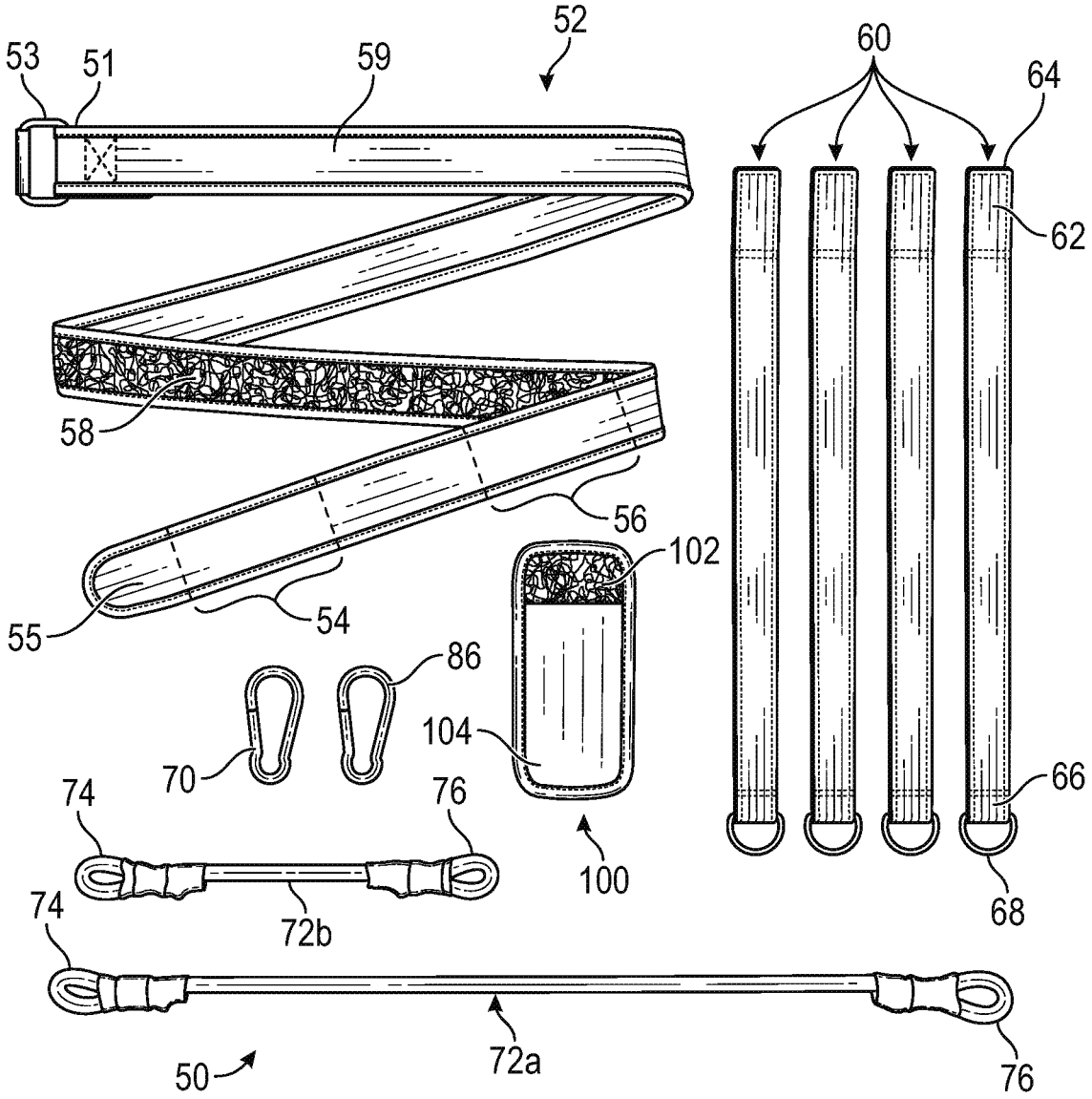
FIG. 3 is a view of the attachment kit of the present disclosure.
Figure 4:
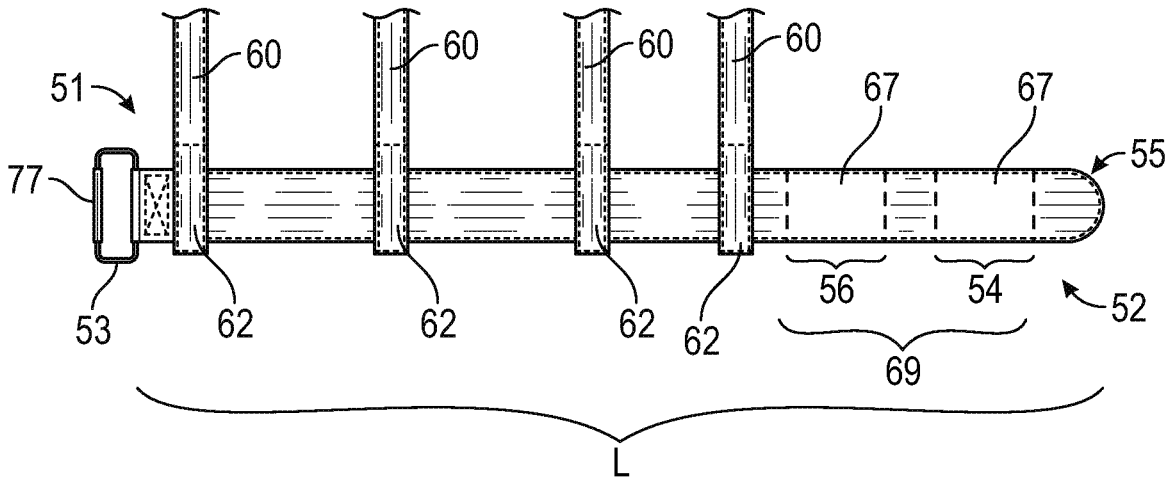
FIG. 4 is a view of the securing strap of the attachment kit of the present disclosure.

Referring to FIGS. 1-6, the attachment kit 50 includes a securing strap 52 configured to be secured about the circumference of the main body 12. As illustrated in FIGS. 3 and 4, securing strap 52 includes a buckle 53 having an opening 77 secured to a first end 51 of securing strap 52. Securing strap 52 includes a first length 54 of a hook/loop portion 67 and a second length 56 of a hook/loop portion 67 of a fastening mechanism 69 secured to first side 58 of the securing strap 52. While a hook and loop securing mechanism on the securing strap 52 along with the buckle are described and illustrated, other fastening mechanisms are within the scope of the present disclosure including, but not limited to a buckle with a prong that is positioned within one of a plurality of apertures, a lobster clasp on the securing strap with a slide to adjust the length, and a side release buckle on the securing strap with a slide to adjust the length.

FIG. 4 illustrates securing strap 52 having a length L between first end 51 and second end 55. Before securing the securing strap 52 to the main body 12 of heavy bag 10, a plurality of connecting straps 60 are retained to the securing strap 52 by positioning a second end 55 of securing strap 52 through a connecting end loop 62, that is typically stitched, proximate a first connecting end 64. With securing strap 52 positioned through connecting end loop 62 in each of the plurality of connecting straps 60, securing strap 52 is secured to the main body 12 of heavy bag 10.

Figure 5:
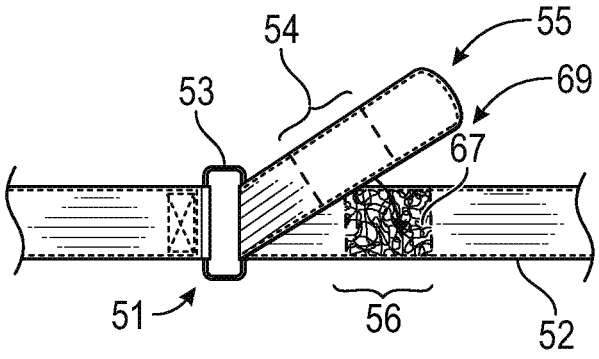
FIG. 5 is a view of the securing strap of the attachment kit of the present disclosure.

FIG. 5 illustrates an embodiment of securing the securing strap 52 about the main body 12 of heavy bag 10 by positioning a second side 59 of securing strap 52 proximate the main body 12 and positioning second end 55 of securing strap 52 through buckle 53 until securing strap 52 is cinched tight to the main body 12. With the securing strap 52 cinched tight to the main body 12, first length 54 is secured to second length 56 using the hook/loop portions 67. As securing strap 52 is cinched tight to the main body 12, some interior ballast shifts, which causes a slight indent into the main body 12, which aids in retaining securing strap 52 to the main body 12.

As shown in FIGS. 1 and 2, with securing strap 52 secured to the main body 12, the plurality of connecting straps 60 are substantially uniformly spaced about the perimeter of the main body 12. The illustrated embodiments include four connecting straps 60, however the plurality of connecting straps 60 can include using two or more connecting straps 60 or three or more connecting straps 60.

FIG. 3 illustrates an embodiment of a first connecting end 64 of each of the plurality of connecting straps 60 including connection ring 68, such as a D-ring or another type of connecting ring, within loops, that are typically stitched. Connection rings 68 are gathered and retained with a clip 70, for example a spring-loaded clip or carabiner. An upper loop 74 of a tether 72*a* or 72*b* is also retained with the clip 70. A lower loop 76 of the tether 72 is secured to the anchor 80 with a clip 86, such as a spring-loaded clip or carabiner, where the clip 86 is typically secured to a ring 82 of anchor 80. As illustrated the clips 70 and 86 are the same construction, such that the clips 70 and 86 are interchangeable without affect the performance of the attachment kit 50.

Depending upon the height of the elevated support 30 and a length of heavy bag 10, the attachment kit 50 includes tethers 72*a* and 72*b* of different lengths to aid controlling the movement of the lower end 16 of heavy bag 10. The tethers 72 can be of a fixed length, such as rope, or can have elastic properties, such as a bungee, a tie down strap or tarp strap, to allow for the elongation of the tether 72 after heavy bag 10 is struck where the tether 72 aids in dissipating the force of the strike and in returning heaving bag 10 to a resting position.

As illustrated in FIG. 1, anchor 80 is a sand filled weight. However, anchor 80 can be any suitable mechanism including an anchor mounted into a floor and/or a device configured to accept metal weight plates. Whatever anchor is utilized, the movement of anchor 80 is to be minimized or be stationary to aid in limiting movement of the lower end 16 of heavy bag 10.

Figure 6:
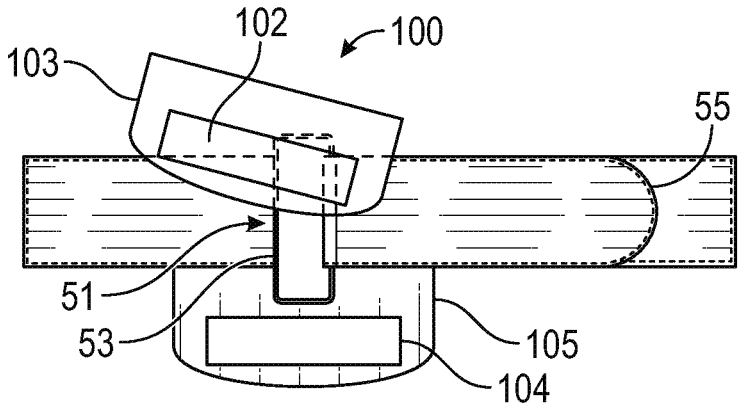
FIG. 6 is a view of the securing strap of the attachment kit of the present disclosure.

FIG. 6 illustrates a protective wrap 100 that is configured to be secured about the buckle 53. Protective wrap 100 includes a length of loops 102 secured to a first protective wrap end 103 and a length of hooks 104 secured on an opposite side at a second protective wrap end 105 of the protective wrap 100 where the loops 102 and hooks 104 are removably secured together to retain the protective wrap 100 about the buckle 53. Protective wrap 100 provides the benefit of eliminating hard areas on the protective strap that could injure a person using heavy bag 10.

Figure 7:
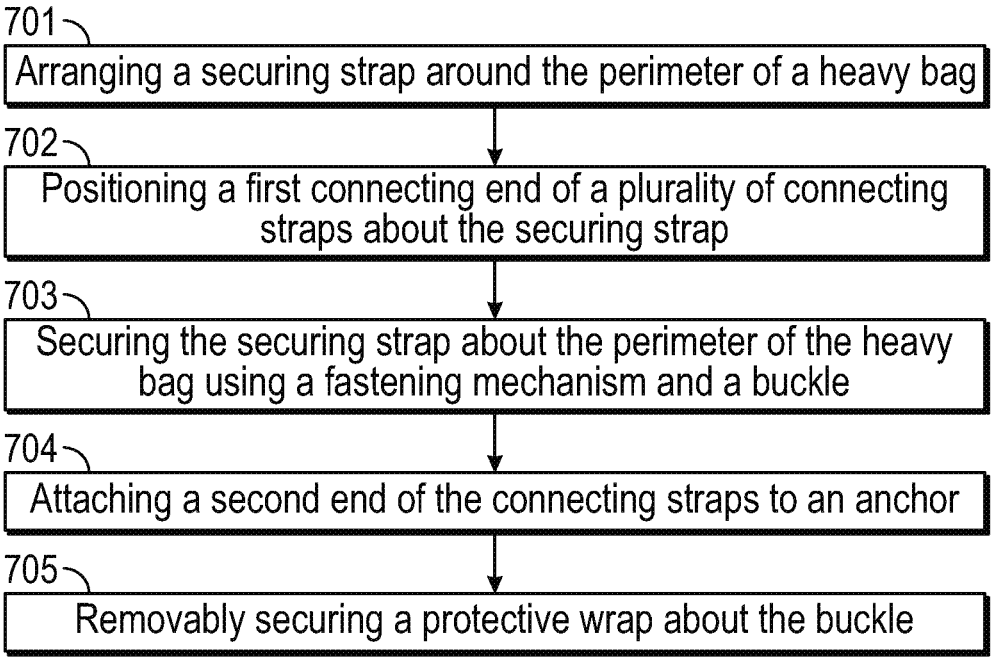
FIG. 7 is a method of attaching the attachment kit of the present disclosure.

FIG. 7 illustrates a method of attaching the attachment kit to a heavy bag. After the heavy bag is hung, a first step 701 is to arrange securing strap 52 with a plurality of connecting straps 60 around the perimeter proximate the lower end 16 of heavy bag 10.

A second step 702 is positioning the plurality of connecting straps 60, with first connecting end 64 movable on the securing strap 52 and the second connecting end 66 being free, substantially uniformly spaced about the perimeter of the heavy bag 10.

A third step 703 is to secure securing strap 52 about the perimeter of the heavy bag 10 using fastening mechanism 69. In an embodiment, the fastening mechanism 69 includes overlapping spaced apart hook/loop portions 67 on one side of securing strap 52 towards second end 55 of securing strap 52 by positioning the second end 55 of the securing strap 52 through an opening 77 of the buckle 53 arranged at the first end 51 of the securing strap 52. The second end 55 is then pulled to tighten the securing strap 52 tight around heavy bag 10 and the free end of the securing strap 52 is then overlapped to engage the hook/loop portions 67 and retain the securing strap 52 to the heavy bag 10.

In a fourth step 704, each of the second connecting ends 66 of the plurality of connecting straps 60 are coupled to an anchor 80. In some embodiments, second connecting ends 66 are connected to tether upper loop 74 portion. Each end of second connecting ends 66 includes connection ring 68 for connecting second connecting ends 66 to tether 72 or anchor 80. Further, tether lower loop 76 may include ring 86, such as a spring-loaded clip, for ease of connecting to anchor 80.

In an optional fifth step 705, a protective wrap 100 positioned about the buckle 53. The protective wrap 100 is positioned between the buckle 53 and the heavy bag 10. In some embodiments, as described above, length of loops 102, arranged at first protective wrap end 103, is secured to length of hooks 104, arranged at second protective wrap end 105 to cover the buckle 53. In the event the attachment kit 50 is to be removed from the heavy bag 10, the buckle 53 is accessed by removing protective wrap 100.

Although the present disclosure has been described with reference to preferred embodiments, workers skilled in the art will recognize that changes may be made in form and detail without departing from the spirit and scope of the disclosure.

The invention claimed is:

1. An attachment kit for a heavy bag, the attachment kit comprising:

a securing strap having a length between a first end and a second end and a securing mechanism configured to retain the securing strap about a perimeter of the heavy bag, the securing strap comprising:

a buckle secured to the first end of the securing strap, the buckle having a slot; and spaced apart hook and loop sections along the length of the securing strap;

a plurality of connecting straps, each of the plurality of connecting straps comprise a length between a first connecting end and a second connecting end, wherein the first connecting end is configured to be positioned about the securing strap; and a tether having a top end and a bottom end, the top end configured to couple to each of the second connecting ends of the plurality of connecting straps and a bottom end is configured to couple to an anchor;

wherein the second end of the securing strap is configured to be positioned through the slot in the buckle and pulled such that the securing strap engages a perimeter of the heavy bag and the spaced apart hook and loop sections overlap to retain the securing strap to the heavy bag, and wherein when the securing strap is secured about a perimeter of the heavy bag and the tether is secured to the anchor, movement of a lower end of the heavy bag is limited.

2. The attachment kit of claim 1, wherein the tether has elastic properties, such that the tether is configured to elongate and contract.

3. The attachment kit of claim 1, wherein the tether has a fixed length.

4. The attachment kit of claim 1, wherein the plurality of connecting straps is substantially uniformly spaced about the perimeter of the heavy bag when the securing strap is secured about the perimeter of the heavy bag.

5. The attachment kit of claim 1, wherein the tether comprises a tether upper loop configured to attach to the second connecting end of each of the plurality of connecting straps.

6. The attachment kit of claim 1, wherein the tether comprises a tether lower loop configured to be secured to the anchor with a ring.

7. The attachment kit of claim 6, wherein the ring is a spring-loaded clip.

8. The attachment kit of claim 1, further comprising a protective wrap, wherein the protective wrap includes a length of loops and a length of hooks secured on opposite sides of the protective wrap where the loops and hooks are configured to be removably secured together to retain the protective wrap about the buckle.

9. The attachment kit of claim 1, wherein each of the plurality of connecting straps includes a ring secured to the second connecting end.

10. The attachment kit of claim 9, wherein the top end of the tether is secured to each of the rings of the plurality of connecting straps with a clip.

11. A method of limiting movement of a bottom end of a heavy bag, the method comprising:

providing a hanging heavy bag;

providing a securing strap having a first end of a plurality of connecting straps positioned about the connecting strap;

arranging a securing strap around a perimeter of the heavy bag proximate a bottom end of the heavy bag;

pulling a second end of the securing strap through a buckle attached to a first end of the securing strap to cinch the securing strap to the perimeter of the heavy bag; and overlapping a portion of the securing strap proximate the second end over another portion of the securing strap such that hook and loop portions engage to retain the securing strap in a cinched position; and attaching a second end of each of the plurality of connecting straps to an anchor to limit movement of the bottom end of the heavy bag.

12. The method of claim 11, further comprising spacing each of the plurality of connecting straps uniformly about the perimeter of the heavy bag.

13. The method of claim 11, further comprising providing a connection ring at the second connecting ends of the plurality of connecting straps.

14. The method of claim 13, further comprising:

attaching each of the second connecting ends to an upper loop of a tether; and attaching the anchor to a lower loop of the tether.

15. The method of claim 11, further comprising removably securing a protective wrap around the buckle.

16. An attachment kit for a heavy bag, the attachment kit comprising:

a securing strap having a length between a first end and a second end and a securing mechanism configured to retain the securing strap about a perimeter of the heavy bag;

a plurality of connecting straps, each of the plurality of connecting straps comprising:

a length between a first connecting end and a second connecting end;

a first loop proximate the first connecting end, the first loop configured to be positioned about the securing strap;

a second loop proximate the second connecting end; and a ring retained by the second loop;

a tether having a top end and a bottom end, the top end configured to couple to each of the rings proximate the second connecting ends of the plurality of connecting straps and a bottom end is configured to couple to an anchor;

wherein when the securing strap is secured about the perimeter of the heavy bag and the tether is secured to the anchor, movement of a lower end of the heavy bag is limited.

17. The attachment kit of claim 16, wherein the rings are attached to the top end of the tether with a first clip.

18. The attachment kit of claim 16, wherein the bottom end of the tether is attached to the anchor with a second clip.

* * * * *